US006996934B2

(12) United States Patent
Briscoe et al.

(10) Patent No.: US 6,996,934 B2
(45) Date of Patent: Feb. 14, 2006

(54) PRESSURE VENT HURRICANE SHUTTER

(76) Inventors: Thomas R. Briscoe, 2841 Shoreview Dr., Naples, FL (US) 34112; Harley E. Briscoe, 2823 Gulfview Dr., Naples, FL (US) 34112

( * ) Notice: Subject to any disclaimer, the term of this patent is extended or adjusted under 35 U.S.C. 154(b) by 107 days.

(21) Appl. No.: 10/647,673

(22) Filed: Aug. 25, 2003

(65) Prior Publication Data

US 2004/0035056 A1 Feb. 26, 2004

Related U.S. Application Data

(63) Continuation-in-part of application No. 09/966,622, filed on Oct. 1, 2001, now abandoned.

(51) Int. Cl.
*E06B 5/10* (2006.01)

(52) U.S. Cl. ..... 49/67; 52/202; 160/117

(58) Field of Classification Search ..... 160/117, 160/104, 213; 49/61, 63, 67; 52/202, 473, 52/78

See application file for complete search history.

(56) References Cited

U.S. PATENT DOCUMENTS 1,646,522 A * 10/1927 Berg ..... 49/356
2,013,824 A * 9/1935 Ensminger ..... 160/77
2,716,785 A * 9/1955 Schoen ..... 49/176
3,039,155 A * 6/1962 Iacovoni ..... 49/65
3,667,161 A * 6/1972 Sassano ..... 49/56
3,691,687 A * 9/1972 Economou ..... 49/74.1
4,368,594 A * 1/1983 Milam et al. ..... 49/67
5,617,683 A * 4/1997 Ney ..... 52/202
5,737,874 A * 4/1998 Sipos et al. ..... 49/67
5,907,929 A * 6/1999 Poma et al. ..... 52/78
6,536,174 B1 * 3/2003 Foster et al. ..... 52/473

* cited by examiner

*Primary Examiner*—David Purol
(74) *Attorney, Agent, or Firm*—The Livingston Firm; Edward M. Livingston; Angela M. Miller

(57) ABSTRACT

A pressure-vent hurricane shutter having predetermined requisite strength of shutter framework (1) encompassing slatted-louver apertures (31) with slat-support guides (6) and (7) for protection against storm-borne objects, wind and rain and venting harmful buildups and bursts of pressure from vacuums created on building from hurricane forces. The shutter framework includes structural beams to which ends of slanted slats (5) are attached rigidly. Ends of slat-support guides (6) and (7) are affixed intermediate the ends of both the inward edges of the slanted slats (20) and the outward edges of the slanted slats (25). The shutter framework (1) have hold down tabs (12) to keep the shutter framework (1) from being blown open during a storm. The shutter framework (1) has ribbed hinges (17) to at least one side of a building aperture in accordance with desired shutter style and structure which include top-hinged Bahama Shutters (29) and sides-hinged Colonial Shutters (30).

18 Claims, 8 Drawing Sheets

PRESSURE VENT HURRICANE SHUTTER

CROSS REFERENCE TO RELATED APPLICATION

This is a continuation in part of application Ser. No. 09/966,622 filed Oct. 1, 2001, now abandoned.

BACKGROUND OF THE INVENTION

This invention relates to hurricane shutters and more particularly to a hurricane shutter that protects requisitely against storm-borne objects, wind and rain while also venting buildups and bursts of pressure and vacuum that react on buildings from hurricanes and other severe storms.

Devastation from severe hurricanes has resulted in storm-area legal requirements and personal interest in adequate storm protection that also is attractive, convenient and, if possible, low cost. Numerous storm-protective shutters have occurred as a result. None, however, help to deflect strong hurricane force winds while addition to providing requisite protection against storm-borne objects, wind and rain in a manner taught by this invention.

Examples of the most-closely related known but different devices are described in the following patent documents:

| Number | Inventor | File Date | Issue Date | Classification |
|---|---|---|---|---|
| U.S. 6,536,174 B | Foster et al. | May 07, 2001 | Mar. 25, 2003 | 52/473 |
| U.S. 3,039,155 | Iacovoni | Oct. 07, 1959 | Jun. 19, 1962 | 49/67 |
| U.S. 5,737,874 | Sipos et al. | Dec. 15, 1994 | Apr. 14, 1998 | 49/67 |
| U.S. 5,907,929 | Poma et al. | Nov. 21, 1997 | Jun. 01, 1999 | 49/62x |
| U.S. 5,617,683 | Ney | Mar. 25, 1996 | Apr. 08, 1997 | 52/202 |
| U.S. 4,368,594 | Milam et al. | Feb. 12, 1981 | Jan. 18, 1983 | 49/67 |
| U.S. 2,013,824 | Ensminger | | September 1935 | 160/77 |
| U.S. 1,646,522 | Berg | | October 1927 | 49/356 |
| U.S. 2,716,785 | Schoen | Oct. 21, 1953 | Sep. 06, 1955 | 49/67 |
| U.S. 3,667,161 | Sassano | Oct. 16, 1970 | Jun. 06, 1972 | 49/56 |
| U.S. 3,691,687 | Economou | Aug. 06, 1971 | Sep. 19, 1972 | 49/74 |

The Foster et al., Iacovoni, and Sipos et al. shutters do not provide weld guides to keep shutters from turning in during hurricane forces as taught by this invention. The Poma et al. shutter requires a removable rigid support for requisite protection. Shutters described by Ney, Milan et al., Ensminger, Berg and Schoen do not have pressure venting as taught by this invention. The Sassano patent does not disclose shutters, but rather a shutter operating mechanism. The Economou shutter teaches slidable slats not requiring weld guides for support.

SUMMARY OF THE INVENTION

Objects of patentable novelty and utility taught by this invention are to provide a pressure-vent hurricane shutter which:

vents damaging buildups and bursts of pressure and vacuum that react on buildings from hurricanes;

provides legally requisite protection against storm-borne objects, wind and rain;

can be made attractive in a variety of structural styles; and can be cost-effective for the level of protection provided.

This invention accomplishes these and other objectives with a pressure-vent hurricane shutter having preferably at least legally-requisite strength of framework encompassing slatted-louver apertures for protection against storm-borne objects, wind and rain in addition to venting damaging buildups and bursts of pressure and vacuum that react on buildings from hurricanes. The framework includes structural beams to which ends of slanted slats are attached rigidly and to which inward edges of the slanted slats are attached to the inward edge of the slat-support guide cover and the outward edges of the slanted slats are attached to the front wall of the slat-support guide. The framework is hinged with the requisite strength to at least one side of a building aperture in accordance with desired shutter style and structure which include top-hinged Bahama and sides-hinged Colonial styles.

BRIEF DESCRIPTION OF DRAWINGS

This invention is described by appended claims in relation to description of a preferred embodiment with reference to the following drawings which are explained briefly as follows:

DESCRIPTION OF PREFERRED EMBODIMENT

Figure 1:
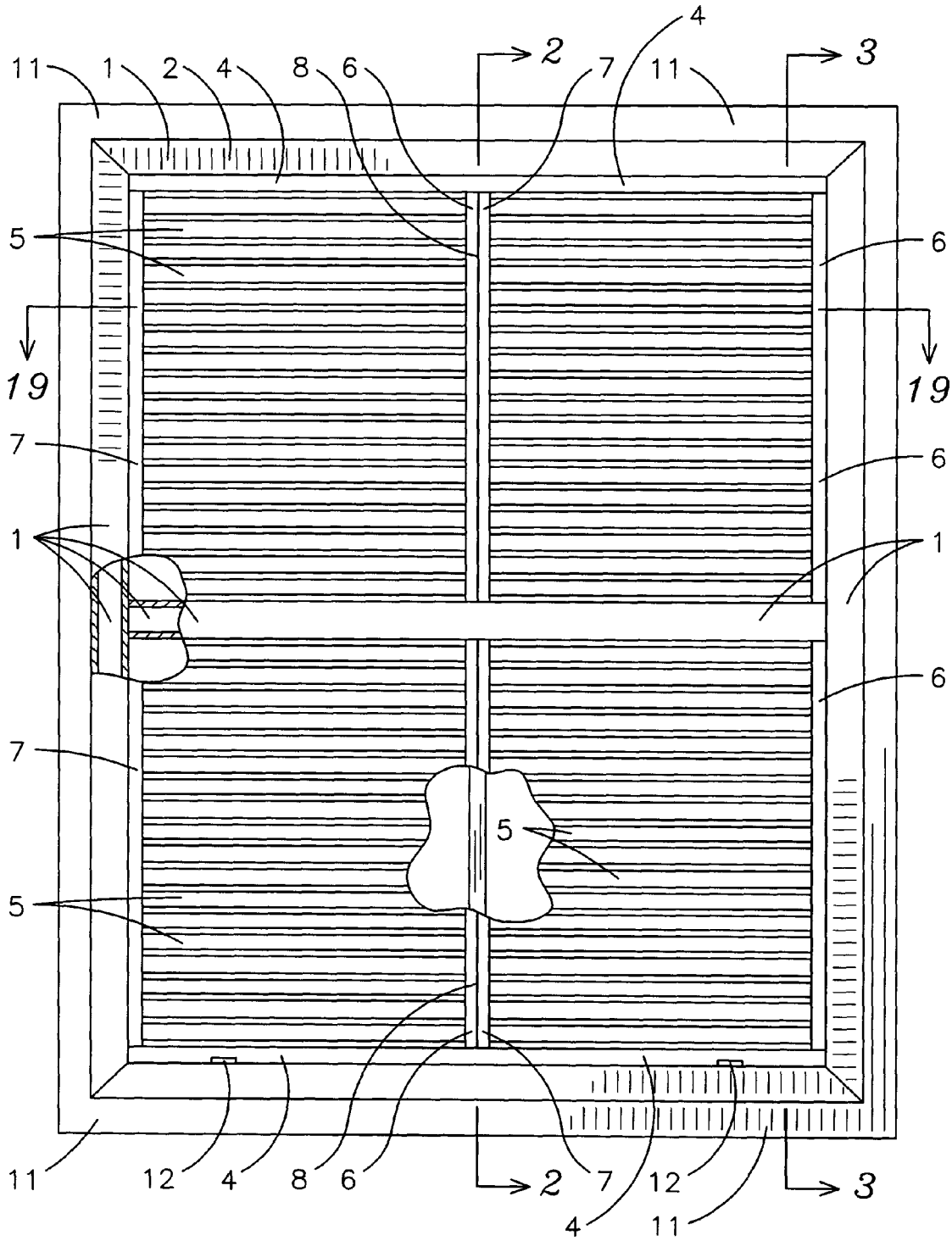
FIG. 1 is a partially cutaway front elevation view of a Bahama-Shutter embodiment.
Figure 2:
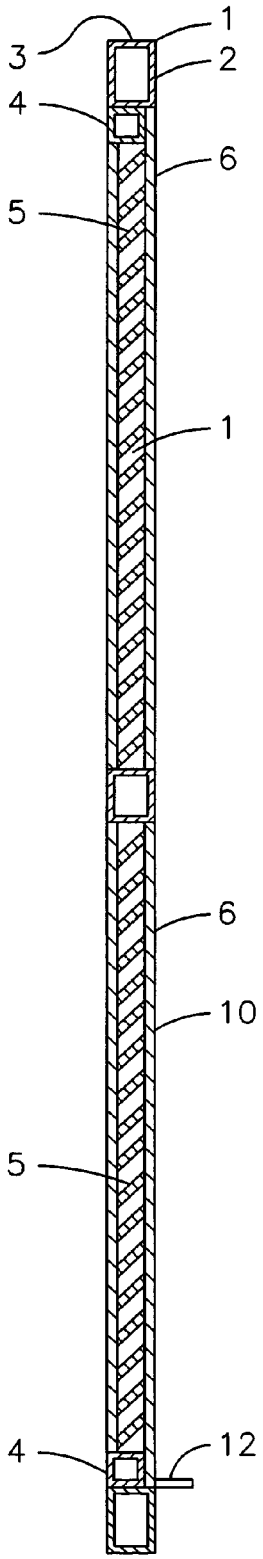
FIG. 2 is a is a section view through section line 2—2 of FIG. 1.
Figure 3:
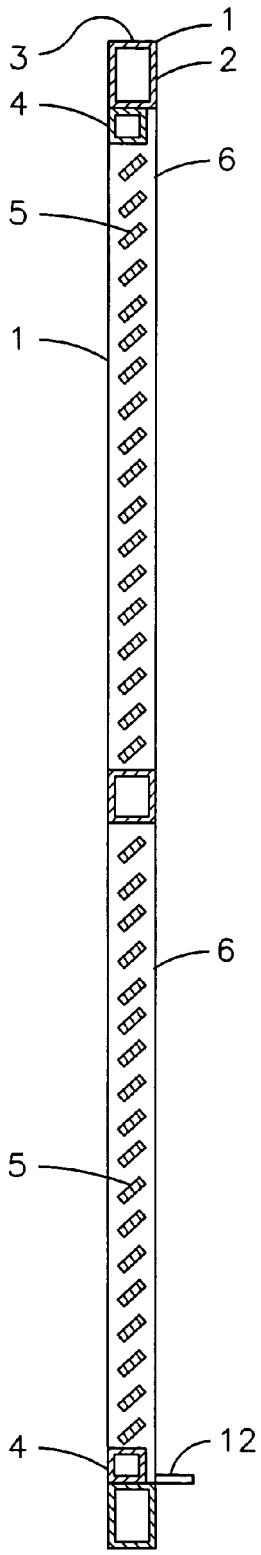
FIG. 3 is a is a section view through section line 3—3 of FIG. 1.
Figure 4:
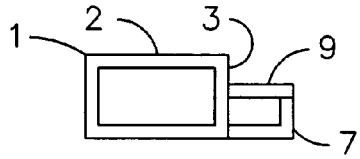
FIG. 4 is an end view of a framework member.
Figure 5:
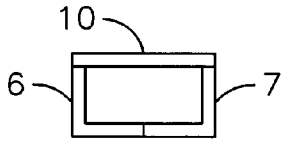
FIG. 5 is an end view of a slat-support guide.

Listed numerically below with reference to the drawings are terms used to describe features of this invention. These terms and numbers assigned to them designate the same features throughout this description.

| | |
|---|---|
| 1. | shutter framework |
| 2. | face walls |
| 3. | edge walls |
| 4. | shutter spacer |
| 5. | slanted slats |
| 6. | right slat-support guide |
| 7. | left slat-support guide |
| 8. | mullion slat-support guide |
| 9. | slat-support cover |
| 10. | mullion slat-support cover |
| 11. | build out framework |
| 12. | hold down tab |
| 13. | shutter hinge assembly |
| 14. | flat hinge assembly |
| 15. | building structure |
| 16. | single hinge |
| 17. | flat hinge |
| 18. | hinge pin |
| 19. | rib |
| 20. | inward edge of slat |
| 21. | outward edges of guide |
| 22. | side wall of slat-support guide |
| 23. | front wall of slat-support guide |
| 24. | inward side of slat-support cover |
| 25. | outward edge of slat |
| 26. | window opening |
| 27. | hold open rod |
| 28. | slot |
| 29. | bahama shutter |
| 30. | colonial shutter |
| 31. | slatted-louver aperture |
| 32. | hole |

Referring to FIGS. 1–5, a pressure-vent hurricane shutter has at least one shutter framework 1 that includes structural beams that preferably are structural metal tubes having face walls 2 that are about one to two inches wide and edge walls 3 that are one-and-one half inches wide. A shutter spacer 4 is located proximate to the shutter framework and is oriented horizontally. The face walls 2 and the edge walls 3 are about one-eighth inch thick and made preferably of structural aluminum alloy 6063-T52 or a substantial equivalent.

The substantial equivalent can be a ferrous alloy that is preferably stainless and rustproof with either an adequate coating or content of nickel, chrome, aluminum or other stainless constituent.

The shutter framework 1 encompasses slatted-louver apertures 31 having slanted slats 5 with slat ends affixed to the shutter framework 1. The slanted slats 5 have inward edges 20 and outward edges 25 that are oriented horizontally and attached to the right slat-support guide 6, the left slat-support guide 7, and the slat-support cover 9. The slat-support guides 6 and 7 are oriented vertically with ends attached to horizontal portions of the shutter framework 1. Both the inward edges of the slats 20 and the outward edges of the slats 25 are orthogonal to the slat-support guides 6 and 7. The inward edges of the slats 20 are attached to the inward side of the slat-support cover 24. The outward edges of the slats 25 are attached to the front wall of the slat-support guide 23. The slats 5 feed into the slots 28 located on the side walls of the slat-support guide 22.

The shutter framework 1 also encompasses hold down tabs 12 located on the horizontal portions of the shutter framework 1. The hold down tabs 12 on Bahama Shutters 29 are located on the bottom horizontal shutter framework 1. The hold down tabs 12 on Colonial Shutters 30 are located on the top and bottom horizontal shutter framework 1. A quarter-inch screw is inserted through the hold down tab 12 into build out framework 11 correspondingly mounted onto the building structure 15. The hold down tabs 12 hold the shutter framework 1 to the build out framework 11 to keep the shutter framework 1 from blowing open during a storm. Flat hinges 17 with ribs 19 are located on the shutter framework 1 to keep the shutter framework 1 from hitting the single hinge 16, thus preventing paint from rubbing off of the single hinge 16.

The slatted-louver apertures 31 includes an entire slatted enclosure of a plurality of apertures between the slanted slats 5 and the shutter framework 1. The plurality of apertures individually are slanted with preferably about one-half inch of distance of slant orthogonally between surfaces of the slanted slats 5. The slanted slats 5 are preferably flat aluminum bar stock about one-quarter inch thick and one inch wide. Between bottoms and tops of adjacent slanted slats 5, there are horizontal apertures about one-eighth inch high and having a length that is a length of the slanted slats 5, less a width of the slat-support guides 6 and 7. The slat-support guides 6 and 7 have a side wall 22, a front wall 23, and a back slat-support cover 9. The slat-support guides 6 and 7 are attached to the inward edges of the slats 20 as well as the outward edges of slats 25 to keep the slanted slats 5 from turning in and maintaining proper separation and angle when under pressure from high winds and wind borne objects. The slat-support guides 6 and 7 and the mullion slat support cover 10 have the appearance of a rectangular mullion so as to give a more aesthetic appearance.

A pressure-vent object of this hurricane shutter is to allow predeterminedly slight passage of wind and rain horizontally straight through slatted-louver apertures of the shutter framework 1 and slightly more directional-change passage while also providing structural strength to prevent breakage by storm-borne objects, wind and rain of hurricanes. Allowing directional-change passage of hurricane-force wind and rain while stopping large storm-borne objects and directional-change diversion of small objects like gravel and small debris eliminates directly damaging aspects of hurricanes.

Figure 6:
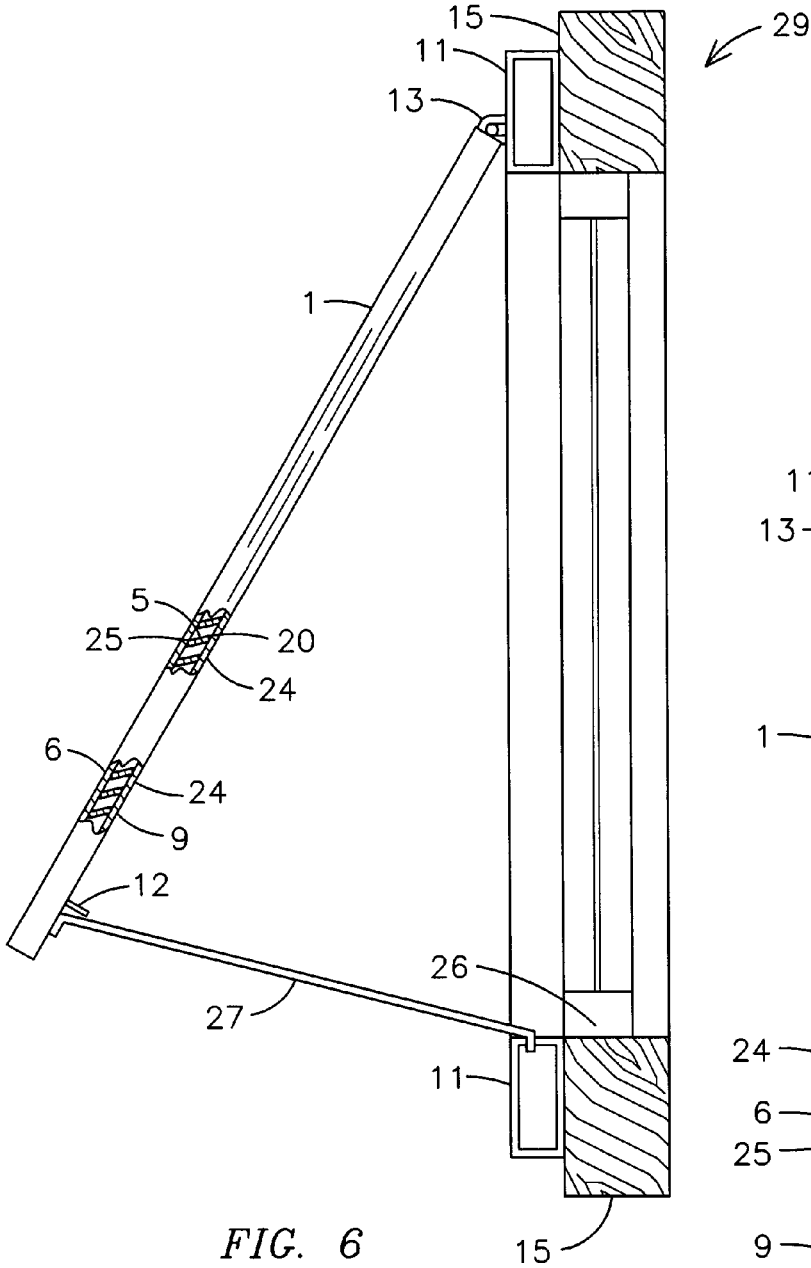
FIG. 6 is a partially cutaway side elevation view of a Bahama-Shutter embodiment mounted on a building structure and being in an open mode.
Figure 7:
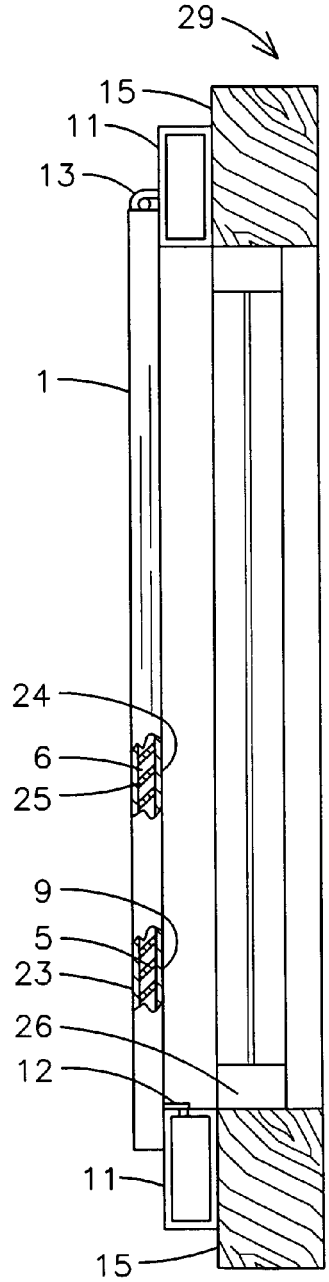
FIG. 7 is the FIG. 6 illustration in a closed mode.
Figure 8:
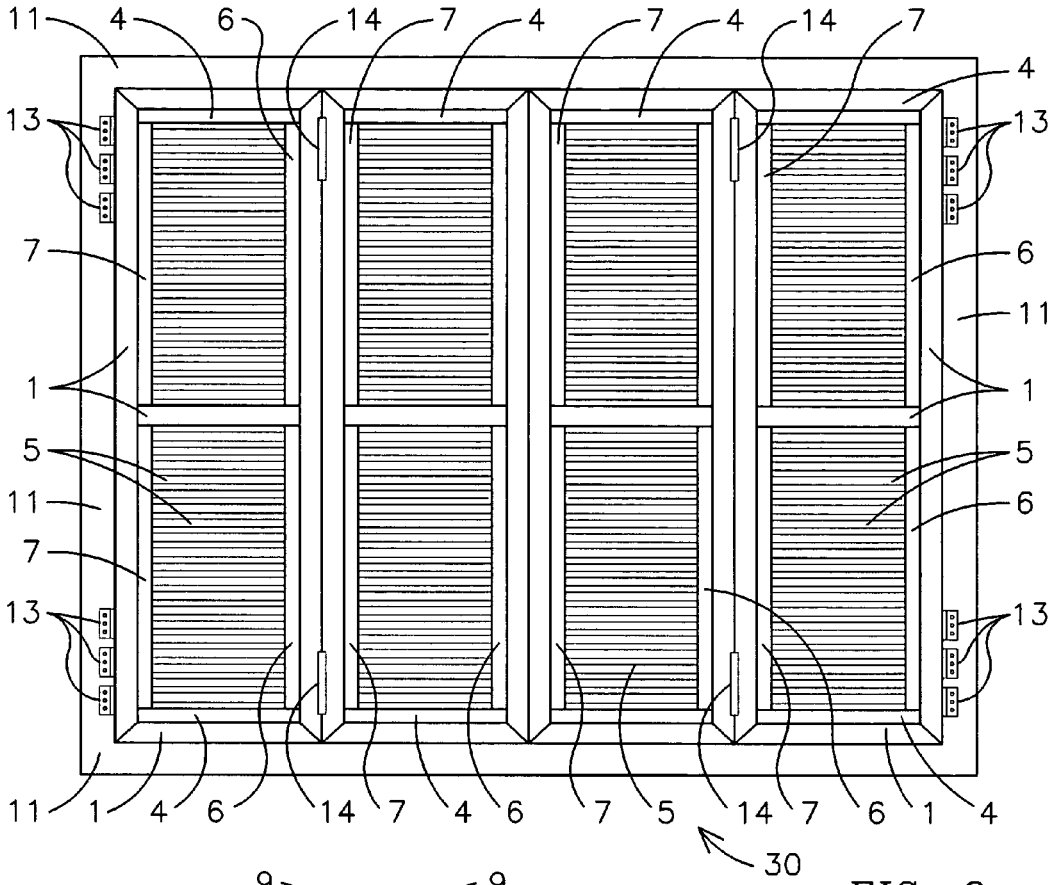
FIG. 8 is a front elevation view of a colonial-shutter embodiment having double-louver sections for average-sized doors and windows in a closed mode.
Figure 9:
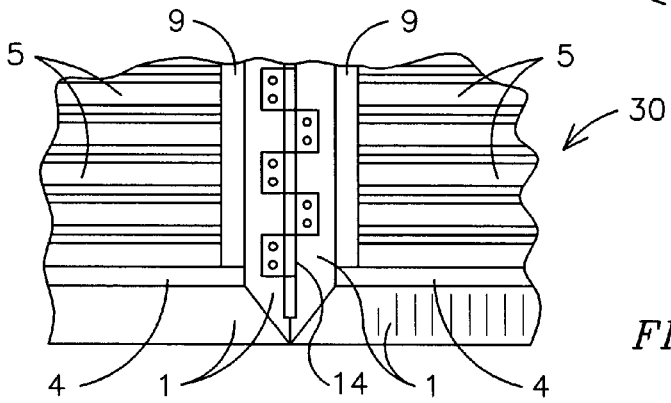
FIG. 9 is a fragmentary view of a colonial-shutter hinge shown hinging two portions of the Colonial Shutter together.
Figure 10:
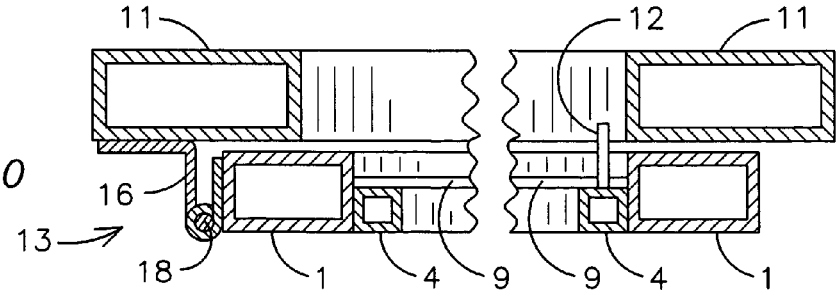
FIG. 10 is a fragmentary end view of a preferred shutter hinge that can be used either horizontally for hang-hinging Bahama Shutters or vertically for swing-hinging Colonial Shutters.
Figure 11:
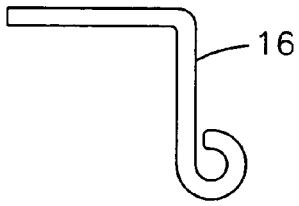
FIG. 11 is an end view of a single shutter hinge that is shown in the FIG. 10 illustration.
Figure 12:
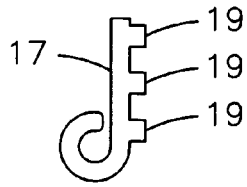
FIG. 12 is an end view of a flat shutter hinge that is shown in the FIG. 10 illustration.
Figure 13:
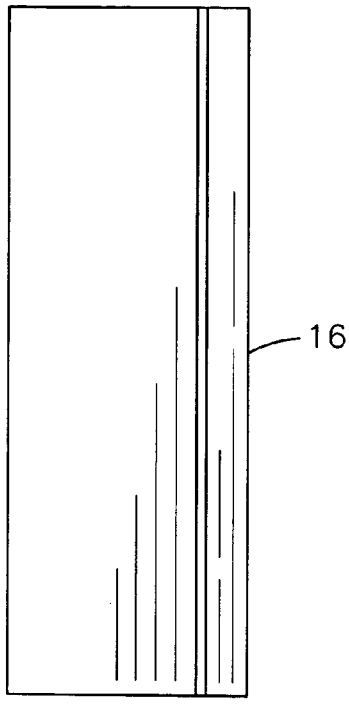
FIG. 13 is a top view of the single shutter hinge that is shown in the FIG. 10 illustration.
Figure 14:
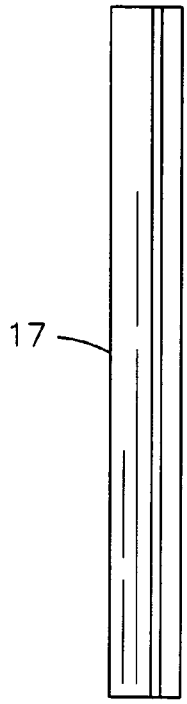
FIG. 14 is a top view of the flat shutter hinge that is shown in the FIG. 10 illustration.

Included on fronts of slatted-louver apertures 31 of Bahama Shutters 29 shown in FIGS. 1–7 and Colonial Shutters 30 shown in FIGS. 8–10 are portions of the slat-support guides 6 and 7 that are straight through horizontally between bottoms and tops of vertically adjacent slanted slats 5. Also shown are portions of a mullion slat-support guide 8 that are slanted between the slanted slats 5 that are juxtaposed vertically.

Referring to FIGS. 6–7, the shutter framework 1 is sized, shaped and designed predeterminedly for a Bahama Shutter 29 having a shutter hinge assembly 13 mounted on top of the shutter framework 1 with which it is hinged to the shutter framework 1 and build out framework 11 on a building structure 15. The top mount shutter hinge assembly 13 is representative of a selection of Bahama Shutter hinges having appropriate strength and operativeness for legal and other predetermined requisites for hinging hurricane shutters to building apertures.

Referring to FIG. 8, the shutter framework 1 is sized, shaped and designed predeterminedly for a Colonial Shutter 30 having a mount shutter hinge assembly 13 mounted on the side of the shutter framework 1 and build out framework 11 on a building structure 15. The structural member includes a Colonial build out frame 15 on the building. The Colonial Shutter 30 includes a flat hinge assembly 14 with which pluralities of the shutter frameworks 1 are hinged together for side-folding.

The build out framework 11 is shown in FIG. 8. The building apertures in the buildings are not shown separately from structural members which include the build out framework 11 in FIG. 8.

Referring to FIG. 9, the flat hinge assembly 14 can include a selection of aluminum hinges and other frame-fold hinges which can be positioned in accordance with folding characteristics of Colonial Shutters. Flat hinge assembly 14 in this illustration are shown on back sides of the shutter framework 1 with the slanted slats 5 and the slat-support guides 6 and 7 being seen in front of the slanted slats 5.

Referring to FIG. 10, the shutter hinge assembly 13 is a preferred hinge that can be used either horizontally for hang-hinging Bahama Shutters 29 or vertically for swing-hinging Colonial Shutters 30. The flat hinges 17 have ribs 19 to keep the shutter framework 1 from hitting the single hinge 16, thus preventing paint from rubbing off of the single hinge 16. For the Colonial Shutters 30, the shutter hinge assembly 13 can be swing-hinged and include a fold-back mode with single hinge 16 attached to the build out framework 11 and with a flat hinge 17 attached to the shutter framework 1 and joined by a shutter-hinge pin 18 as depicted in FIG. 17.

Figure 16:
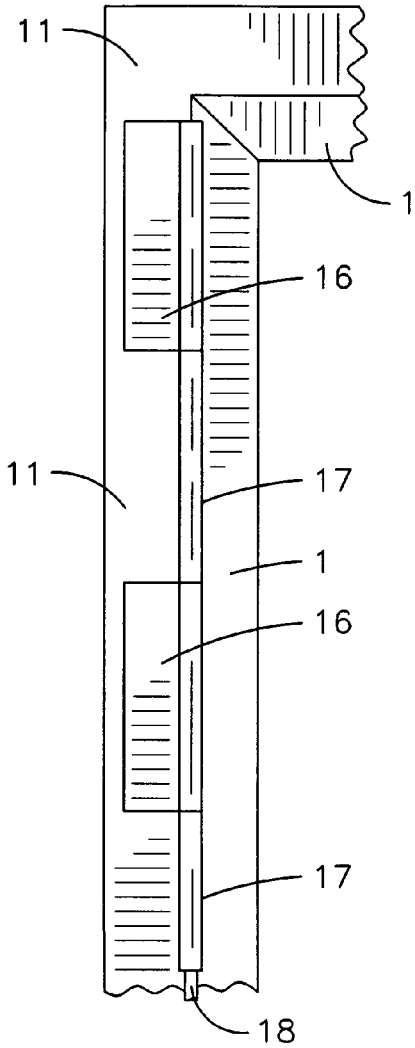
FIG. 16 is a fragmentary side view of the preferred shutter hinge in which the single hinge is shown attached to the build-out frame which is attached to the building structure from a top side of the FIG. 10 illustration and the flat hinge is shown from the bottom of the FIG. 10 illustration.

As shown in FIGS. 6–7 and 16 for the Bahama Shutters 29, the flat hinge 17 with ribs 19 can be hang-hinged and include a hanging mode with single hinge 16 attached to the build out framework 11, with which is attached to the building structure 15. The flat hinges 17 are attached to the shutter framework 1 and joined by a hinge pin 18 as depicted in FIG. 16. The hold down tabs 12 are located on the horizontal portion of the shutter framework 1. A one-quarter inch screw is inserted through the hold down tab 12 into the build out framework 11 correspondingly mounted onto the building structure 15. The hold down tabs 12 hold the shutter framework 1 to the build out framework 11, helping to keep the shutter framework 1 from blowing open during a storm.

Figure 17:
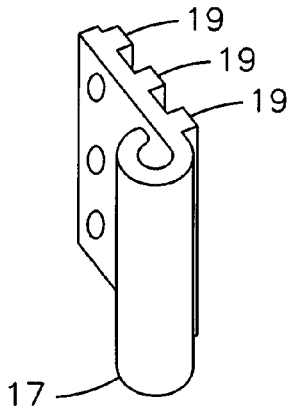
FIG. 17 is a perspective view of a flat shutter hinge with ribs.
Figure 18:
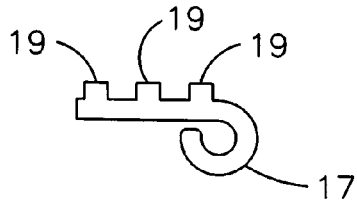
FIG. 18 is a side view of a flat shutter hinge with ribs.
Figure 15:
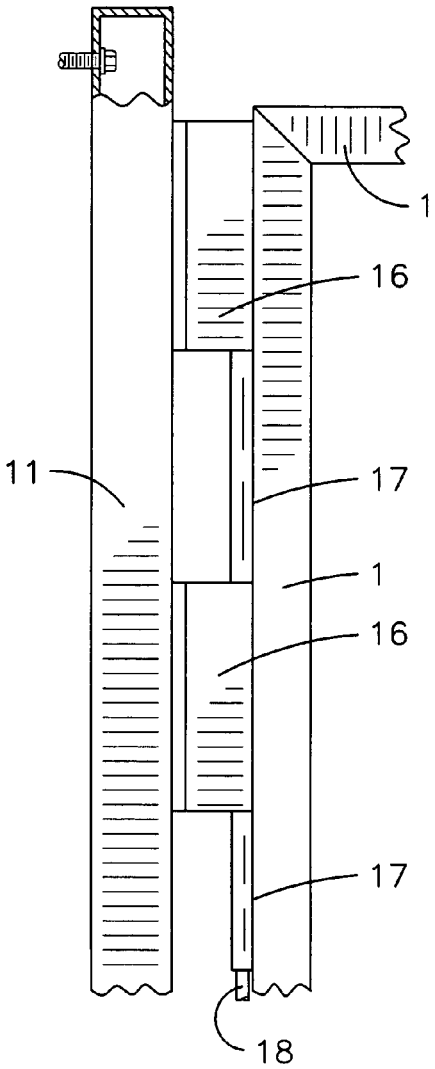
FIG. 15 is a fragmentary side view of the preferred shutter hinge in which the single hinge is shown attached to a metallic or other rigid form as seen from a left side of the FIG. 10 illustration and the flat hinge is shown from a bottom of the FIG. 10 illustration.

Referring to FIGS. 17 and 18, the flat hinge 17 is shown with ribs 19 in detail.

Figure 19:
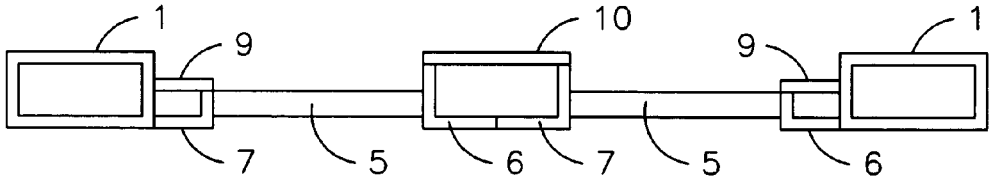
FIG. 19 is a section view through section line 19—19 of FIG. 1.

Referring to FIG. 19, a cross-section of slanted slat 5 is shown affixed to slat-support guides 6 and 7. The slat-support guides 6 and 7 and the ends of the slanted slats 5 in turn, are affixed to the shutter framework 1. The slat-support cover 9 is affixed to the back of the slat-support guides 6 and 7 and to the edge walls 3 of the shutter framework 1.

Figure 20:
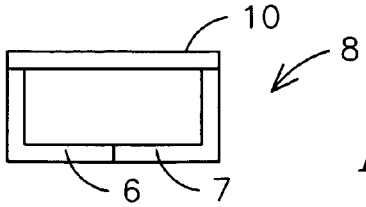
FIG. 20 is an end view of a mullion slat-support guide assembly.

Referring to FIG. 20, the end view of a mullion slat-support guide 8 is shown. The mullion slat-support guide 8 consists of one right slat-support guide 6, one left slat-support guide 7, one mullion slat-support cover 10 affixed to form a rectangular cross-section.

Figure 21:
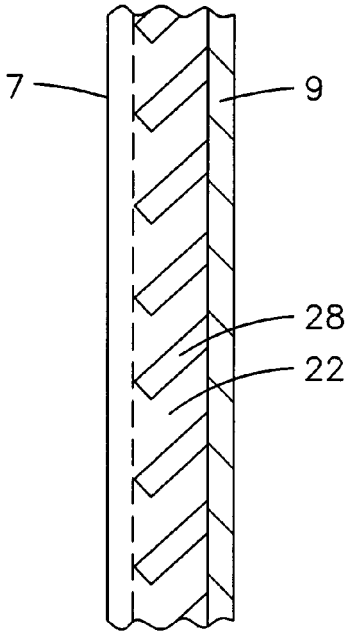
FIG. 21 is a side view of a left slat-support guide.

Referring to FIG. 21, a side view of a left slat-support guide 7 is shown without the slanted slats 5. The side wall 22 has slots 28 where the slanted slats 5 feed into. A slat-support cover 9 would be affixed to the inward edge of slats 20 once placed into the slots 28.

Figure 22:
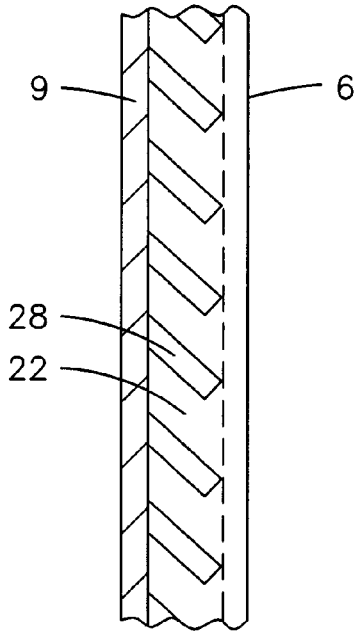
FIG. 22 is a side view of a right slat-support guide.

Referring to FIG. 22, a side view of a right slat-support guide 6 is shown without the slanted slats 5. The side wall 22 has slots 28 where the slanted slats 5 feed into.

Figure 23:
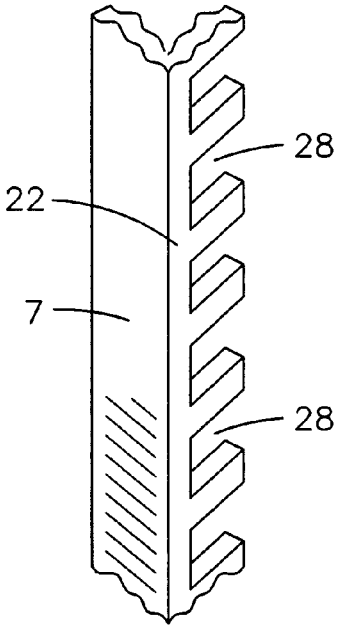
FIG. 23 is a perspective view of a left slat-support guide.

Referring to FIG. 23, a perspective view of a left slat-support guide 7 is shown by itself with slots 28 on the side wall 22.

Figure 24:
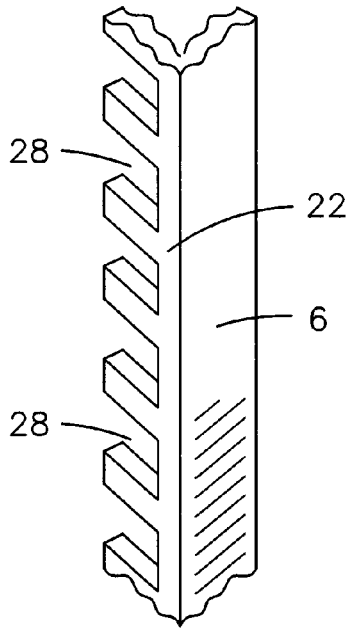
FIG. 24 is a perspective view of a right slat-support guide.

Referring to FIG. 24, a perspective view of a right slat-support guide 6 is shown by itself with slots 28 on the side wall 22.

Figure 25:
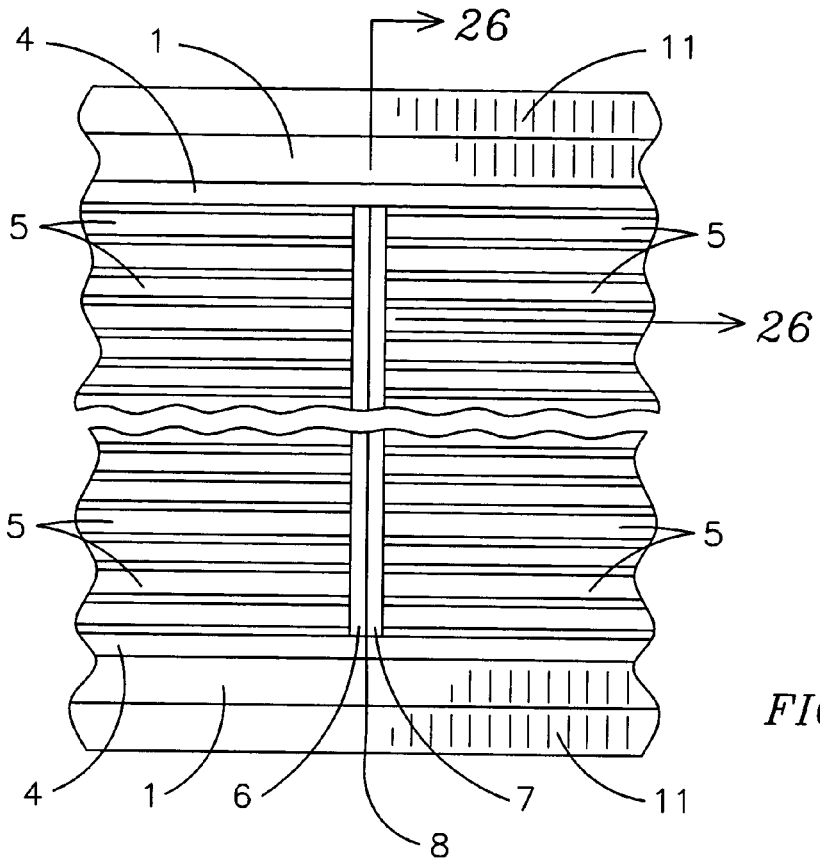
FIG. 25 is a front view of a slat-support guide.

Referring to FIG. 25, a front view of a mullion slat-support guide 8 is shown.

Figure 26:
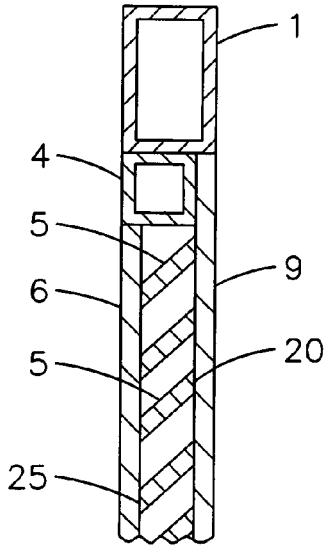
FIG. 26 is a section view through section line 26—26 of FIG. 25.

Referring to FIG. 26, a cross-section of a right slat-support guide 6 is shown. The inward edges 20 of the slanted slats 5 are affixed to the slat-support cover 9.

Figure 27:
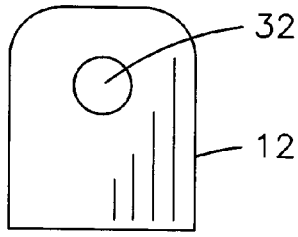
FIG. 27 is a front view of a hold down tab.

Referring to FIG. 27, a front view of a hold down tab 12 with a hole 32 is shown.

The single hinge 16 and the flat hinge 17 of the shutter hinge assembly 13 and flat hinge assembly 14 are made preferably of structural aluminum alloy 6063-T5, 6061-T6 or a substantial equivalent. As for other metallic components, the substantial equivalent can be a ferrous alloy that is preferably stainless and rustproof with either an adequate coating or having suitably alloyed content of nickel, chrome, aluminum and/or other stainless constituent.

A new and useful pressure-vent hurricane shutter having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. A pressure-vent hurricane shutter comprising:

at least one shutter framework encompassing slatted-louver apertures;

said shutter framework including structural beams to which ends of slanted slats for the slatted-louver apertures are affixed;

slat-support guides oriented vertically and having ends;

said shutter framework including a shutter spacer to which said ends of said slat-support guides for the slatted-louver apertures are affixed;

slat-support cover affixed to one slat-support guide;

mullion slat-support cover affixed to at least two adjacent slat-support guides;

said structural beams on said shutter framework affixed to the outside edge of said slat-support guides;

the slanted slats having inward edges that are oriented orthogonally to the mullion slat-support covers;

the slanted slats having outward edges that are oriented orthogonally to the slat-support guides;

the inward edges intermediate the ends of the slanted slats being attached to the mullion slat-support covers;

the outward edges intermediate the ends of the slanted slats being attached to the slat-support guides;

at least one shutter hinge proximate at least one edge of the shutter framework;

the shutter framework being hinged to at least one structural member of a building proximate a building aperture;

the shutter framework, the slanted slats, the slat-support guides and the hinge having a structural composite that has at least predetermined requisite strength for shutter-related protection of the building against storm-borne objects, wind and rain;

the slatted-louver apertures having predetermined venting of storm buildups and bursts of pressure and vacuum that react on buildings; and the shutter hinge is ribbed.

2. The pressure-vent hurricane shutter of claim 1 wherein:

the structural beams included in the shutter framework are structural metal tubes having a cross section that is rectangular; and a metal of which the structural metal tubes are made has predetermined material strength, rigidity, thickness and structure for the shutter framework to have the structural composite with at least the requisite strength for shutter-related protection of the building against storm-borne objects, wind and rain.

3. The pressure-vent hurricane shutter of claim 1 wherein:

the structural beams included in the shutter framework are structural aluminum tubes having a cross section that is rectangular with face walls being about one to two inches wide and orthogonal edge walls being about one and one-half inches wide;

the face walls and the edge walls being about one-eighth of an inch thick;

the metal of the structural aluminum tubes being aluminum alloy 6063-T52 or at least a substantial equivalent thereof; and the structural beams of the shutter framework are affixed together at joining edges.

4. The pressure-vent hurricane shutter of claim 1 wherein:

the slanted slats include structural flat-bar metal having a cross section that is rectangular; and a metal of which the slanted slats are made has predetermined material strength, rigidity, thickness and structure for the slanted slats to have the structural composite with at least the requisite strength for slatted-louver protection of the building against storm-borne objects, wind and rain.

5. The pressure-vent hurricane shutter of claim 1 wherein:

the slanted slats are structural aluminum flat bar having a cross section that is rectangular with face walls being about one inch wide and edge walls being about one-quarter of an inch wide;

the slanted slats being about one-quarter of an inch thick;

the metal of the slanted slats being aluminum alloy 6063-T52 or at least a substantial equivalent thereof;

the ends of the slanted slats are affixed to the shutter framework;

the inward edges of the slanted slats are affixed to the slat-support covers; and the outward edges of the slanted slats are affixed to the slat-support guides.

6. The pressure-vent hurricane shutter of claim 1 wherein:

the face walls of the slanted slats are spaced apart about one-half inch orthogonally; and the slanted slats are juxtaposed vertically with dihedral angels of the face walls and dihedral angles of the edge walls being horizontal.

7. The pressure-vent hurricane shutter of claim 1 wherein:

hold down tabs are affixed to horizontal portions of the shutter framework;

said hold down tabs have a hole in which a screw of a predetermined size can be inserted; and said hold down tabs are made of a metal of predetermined material strength, rigidity, thickness and structure for the shutter framework to have the structural composite with at least the requisite strength for shutter-related protection of the building against storm-borne objects, wind and rain.

8. The pressure-vent hurricane shutter of claim 1 wherein:

the shutter framework is a Bahama Shutter having top-hinge with which it is hinged to the structural member of the building proximate the building aperture.

9. The pressure-vent hurricane shutter of claim 1 wherein:

the shutter framework is a Colonial Shutter having side-hinges with which it is hinged to sides of the structural member of the building proximate the building aperture.

10. The pressure-vent hurricane shutter of claim 7 wherein:

the structural member of a proximate a building aperture has a hole corresponding to the location of the hold down tabs.

11. The pressure-vent hurricane shutter of claim 1 wherein:

said slat-support guides have a front wall, two side walls, and a back wall joined together along longitudinal edges of the walls;

the slat-support guides are structural aluminum alloy 6063-T52 or at least a substantial equivalent thereof;

said slat-support guide front and back walls having rectangular cross sections with a width of about one inch and a thickness of about one-eighth inch;

said slat-support guide side walls having rectangular cross sections with a width of about one-half inch and a thickness of about one-eighth inch;

said slat-support guide side walls having slots distributed evenly to correspond with shape, size, and direction of slanted slats;

said slat-support guides have ends which are affixed to the shutter framework;

said front wall of slat-support guide affixed to outward edges of slanted slats;

said back wall of slat-support cover affixed to inward edges of slanted slats; and said slat-support guides have the appearance of mullions.

12. The pressure-vent hurricane shutter of claim 1 wherein:

the shutter framework is sized, shaped-hinge attachment to a top of the structural member of the building proximate the building aperture.

13. A pressure-vent hurricane shutter comprising:

at least one shutter framework encompassing slatted-louver apertures;

the shutter framework is a Bahama Shutter having top-hinge attachment to a top of the structural member of the building proximate the building aperture;

the shutter framework including structural beams to which ends of slanted slats for the slatted-louver apertures are affixed and to which ends of slat-support guides are attached orthogonally to the slanted slats intermediate the ends of the inward and outward edges of the slanted slats;

the shutter framework, the slats, slat-support guides and the hinge having a structural composite that has at least predetermined strength for shutter-related protection of the building against storm-borne objects, wind and rain;

the slatted-louver apertures having predetermined venting of storm buildups and bursts of pressure and vacuum that react on buildings;

the structural beams included in the shutter framework are structural metal tubes having a cross section that is rectangular;

a metal of which the structural metal tubes are made has predetermined material strength, rigidity, thickness and structure for the shutter framework to have the structural composite with at least the predetermined strength for shutter-related protection of the building against storm-borne objects, wind and rain; and the hinge is ribbed.

14. The pressure-vent hurricane shutter of claim 13 wherein:

the structural beams included in the shutter framework are structural aluminum tubes having a cross section that is rectangular with face walls being about one to two inches wide and orthogonal edge walls being about one and one-half inches wide;

the face walls and the edge walls being about one-eighth of an inch thick;

the metal of the structural aluminum tubes being aluminum alloy 6063-T52 or at least a substantial equivalent thereof;

the structural beams of the shutter framework are affixed together at joining edges;

the slanted slats include structural flat-bar metal have a cross section that is rectangular;

a metal of which the slanted slats are made has predetermined material strength, rigidity, thickness and structure for the slanted slats to have the structural composite with at least the predetermined strength for slatted-louver protection of the building against storm-borne objects, wind and rain;

the slanted slats are structural aluminum flat bar having a cross section that is rectangular with face walls being about one inch wide and edge walls being about one-quarter inch wide;

the slanted slats being about one-quarter inch thick;

the metal of the slanted slats being aluminum alloy 6063-T52 or at least a substantial equivalent thereof;

the ends of the slanted slats are affixed to the shutter framework;

the slat-support guides are structural aluminum alloy 6063-T52;

the slat-support guides have ends which are affixed to the shutter framework; and the inward edges of the slanted slats are affixed to the front wall of the slat-support guides.

15. The pressure-vent hurricane shutter of claim 13 wherein: the face walls of the slanted slats are spaced apart about one-half inch orthogonally; and the slanted slats are juxtaposed vertically with dihedral angles of the face walls and dihedral angles of the edge walls being horizontal.

16. The pressure-vent hurricane shutter of claim 13 wherein:

hold down tabs are affixed to bottom portion of horizontal shutter framework;

said hold down tabs have a hole in which a screw of a predetermined size can be inserted; and said hold down tabs are made of a metal of predetermined material strength, rigidity, thickness and structure for the shutter framework to have the structural composite with at least the requisite strength for shutter-related protection of the building against storm-borne objects, wind and rain.

17. The pressure-vent hurricane shutter of claim 16 wherein:

the structural member of a proximate a building aperture has a hole corresponding to the location of the hold down tabs.

18. The pressure-vent hurricane shutter of claim 13 wherein:

said slat-support guides have a front wall, two side walls, and a back wall joined together along longitudinal edges of the walls;

the slat-support guides are structural aluminum alloy 6063-T52 or at least a substantial equivalent thereof;

said slat-support guide front and back walls having rectangular cross sections with a width of about one inch and a thickness of about one-eighth inch;

said slat-support guide side walls having rectangular cross sections with a width of about one-half inch and a thickness of about one-eighth inch;

said slat-support guide side walls having slots distributed evenly to correspond with shape, size, and direction of slanted slats;

said front wall of slat-support guide affixed to outward edges of slanted slats;

said back wall of slat-support guide affixed to inward edges of slanted slats;

said slat-support guides have ends which are affixed to the shutter framework; and said slat-support guides have the appearance of mullions.

* * * * *